US007175161B2

(12) United States Patent
Hochmeyer et al.

(10) Patent No.: US 7,175,161 B2
(45) Date of Patent: Feb. 13, 2007

(54) POWER CARPET KICKER

(76) Inventors: Michael A. Hochmeyer, 136 Harrington Ave., Westwood, NJ (US) 07675; Paul F. Anthony, 31 Windsor Rd., Oradell, NJ (US) 07649

( * ) Notice: Subject to any disclaimer, the term of this patent is extended or adjusted under 35 U.S.C. 154(b) by 0 days.

(21) Appl. No.: 11/186,732

(22) Filed: Jul. 21, 2005

(65) Prior Publication Data

US 2006/0022181 A1 Feb. 2, 2006

Related U.S. Application Data

(60) Provisional application No. 60/590,411, filed on Jul. 21, 2004.

(51) Int. Cl.
*B25B 25/00* (2006.01)

(52) U.S. Cl. ..... 254/201; 254/212; 294/8.6

(58) Field of Classification Search ..... 254/200, 254/201, 212; 294/8.6
See application file for complete search history.

(56) References Cited

U.S. PATENT DOCUMENTS 3,951,382 A * 4/1976 Asbury ..... 254/201
3,977,651 A * 8/1976 Chamberlain ..... 254/201
4,084,787 A * 4/1978 Kowalczyk ..... 254/201
4,361,311 A * 11/1982 Koroyasu et al. ..... 254/200
4,627,653 A * 12/1986 Koroyasu ..... 294/8.6
5,145,225 A * 9/1992 Muller et al. ..... 294/8.6
5,228,660 A * 7/1993 Massicotte ..... 254/201
5,255,894 A * 10/1993 Guarneri ..... 254/200
6,371,446 B1 * 4/2002 Gauthier et al. ..... 254/201
6,669,173 B1 * 12/2003 Dunn ..... 254/201
6,669,174 B1 * 12/2003 Vita ..... 254/212
6,698,721 B2 * 3/2004 Martin ..... 254/201

* cited by examiner

*Primary Examiner*—Emmanuel M Marcelo
(74) *Attorney, Agent, or Firm*—National IP Rights Center

(57) ABSTRACT

A power carpet kicker is disclosed. The power carpet kicker includes a main frame portion, having a head portion and a rear portion. The head portion of the main frame portion includes a grip mounted on the head portion to grip a section of carpet to be stretched. The rear portion of the main frame portion includes a cushion mounted to the rear portion to provide cushion to an operator's knee. The main frame portion includes a momentum creating device to produce linear force towards the head portion to stretch carpet.

7 Claims, 1 Drawing Sheet

POWER CARPET KICKER

CROSS REFERENCE TO RELATED APPLICATIONS

This application claims benefits to provisional application 60/590,411, filed on Jul. 21, 2004, entitled "Power Carpet Kicker", which is incorporated by reference herein it its entirety.

FIELD OF THE INVENTION

The present invention relates to the field of carpet installation devices, and in particular to a device to stretch carpet for installation.

BACKGROUND OF THE INVENTION

When installing wall-to-wall carpeting in commercial or residential applications, carpet is rarely cut to the exact dimensions needed. Therefore, carpet installers must stretch portions of carpet to assure an exact and smooth fit. One of the most popular tools for this application is a carpet kicker. Carpet kickers are typically constructed from an elongated rod having a head with a plurality of downwardly extending carpet gripping members at one end and a kneepad at the other. Carpet installers using this device must get down on their hands and knees, use the carpet gripping head of the kicker to engage the carpet close to the edge to be stretched, and then kick the knee pad using a knee, thus stretching the carpet. The edge of the carpet is then pressed down onto the tack strip, which secures the stretched carpet in place. Even if the installer is wearing pads, this action traumatizes the attachment of the quadriceps muscle to the top of the kneecap and is the source of many hip and spinal cord injuries. As a result, a number of less physically demanding carpet kickers have been introduced into the market to prevent carpet installation related injuries.

A number of patents have been directed to carpet kickers and the like. U.S. Pat. No. 5,145,225 discloses a carpet stretcher assembly is provided having a retractable carpet engaging head that can be pneumatically driven by a cylinder assembly. The carpet engaging head is connected to the pneumatic cylinder assembly by a flexible connection whereby the carpet engaging head can automatically be moved to an elevated position relative to a carpet being stretched when the pneumatic cylinder assembly retracts it.

U.S. Pat. No. 6,371,446 discloses a hand-held pneumatic carpet stretcher powered by an associated air compressor, or other source of compressed air, is used to eliminate wrinkles during the installation of wall-to-wall carpet. The carpet stretcher comprises a gripper plate, pile teeth, an air valve controlled by a button, and two pneumatic cylinders acting in conjunction with two piston rods connected to each other by a piston rod connector.

U.S. Pat. No. 4,361,311 discloses a carpet stretcher device comprising a body case having a handle fixed to the upper surface thereof, an electromagnetic coil axially installed in the body case, a plunger axially slidably fitted in the inner surface of the electromagnetic coil and normally urge rearwardly by a spring, and a spindle fixed to the rear end of an engaging head for engagement with carpets and axially slidably fitted in the front end of the body case, the arrangement being such that upon energization of the electromagnetic coil the plunger is advanced to strike the rear end of the engaging head with its front end U.S. Pat. No. 5,228,660 discloses a power operated carpet stretcher comprising a frame having a bottom surface provided with prong members positioned and sized to grasp a carpet. A hook is slidably mounted on the frame to engage a slat fixed to the floor adjacent a wall edge. The hook is operatively connected to a power jack in such a manner that, upon actuation of the power jack, the frame is pulled toward the slat engaged by the hook thereby causing the carpet to be pulled by the prong members toward the adjacent wall edge. A method of installing a carpet with this stretcher is also disclosed.

U.S. Pat. No. 6,669,174 discloses a knee-less kicking tool for stretching a carpet. A base rests on the carpet. A head is attached to the base and engages and stretches the carpet when an apparatus for propelling the head is activated. The apparatus includes a pair of rods that extend across the base and a ram. The ram has a body that slides on the pair of rods. When the ram is slid forwardly on the pair of rods and impacts upon the base, the head is caused to move forward and stretch the carpet. The ram further has a handle that extends from the body thereof and is grabbed by the hand of a user and used to slide the ram forwardly, and a weight that extends upwardly from the body thereof and which increases the impact of the ram on the base when the ram is slid forwardly on the pair of rods.

U.S. Pat. No. 5,288,057 discloses a carpet-stretching device using a power-stretching adapter attached to a standard carpet kicker is provided. The stretching adapter is formed from a frame having an anchor plate attached to the front of the frame for anchoring the device between the wall and tack strip adjacent to the carpet edge to be stretched. A handle is provided which is pivotally attached along its lower portion to the back of the frame. A clamp is located at the bottom of the handle for attaching the handle to a standard carpet kicker adjacent to the head of the kicker, so that the head will be positioned between the anchor plate and the clamp. The device functions by placing the handle upright, placing the anchor between the wall and tack strip, engaging the carpet pile with the carpet kicker head, and pivoting the top of the handle down towards the knee pad of the carpet kicker, forcing the kicker head towards the anchor, thus stretching the carpet. A tucker assembly is also provided for forcing the stretched carpet into engagement with the tack strip.

There is a need however, for a device that employs the efficient and proven design of a standard knee driven carpet kicker, but reduces the violent force that is necessary for carpet installers to effectively install carpeting.

OBJECTS AND SUMMARY OF THE INVENTION

It is an object of the present invention to provide a tool for a carpet installer that allows the installer to easily stretch carpet.

It is a further object of the present invention to provide a tool for a carpet installer that reduces installation related injuries.

It is yet a further object of the present invention to provide a tool for a carpet installer that will be easily adaptable to various momentum producing devices.

In accordance with a first aspect of the present invention, a novel powered carpet kicker is disclosed. The novel powered carpet kicker includes a main elongated frame, with a plurality of gripping spikes at its head and a cushion knee pad at it rear. The center of the main frame portion contains a momentum producing device that is situated lengthwise.

The momentum producing device creates linear force toward the head portion of the main frame to stretch the carpet.

In accordance with another aspect of the present invention, a novel electromagnetically powered carpet kicker is disclosed. The novel powered carpet kicker includes a main elongated frame, with a plurality of gripping spikes at its head and a cushion knee pad at it rear. The center of the main frame portion contains a cylinder that is situated lengthwise. A piston is located within the cylinder and slides lengthwise from the front to the rear. Electromagnetic plates are located on each end of the cylinder, and are connected to a control device, which is connected to a power source. The piston is forced down the cylinder by reverse polarity and creates linear force toward the head portion of the main frame to stretch the carpet.

In accordance with another aspect of the present invention, a novel pneumatically powered carpet kicker is disclosed. The novel powered carpet kicker includes a main elongated frame, with a plurality of gripping spikes at its head and a cushion knee pad at it rear. The center of the main frame portion contains a cylinder that is situated lengthwise. A piston is located within the cylinder and slides lengthwise from the front to the rear. Inlet/outlet ports are located on each end of the cylinder, and are connected to the control valve. An actuator is connected to actuate the control valve. The piston is forced down the cylinder by pneumatic force and creates linear force toward the head portion of the main frame to stretch the carpet.

BRIEF DESCRIPTION OF THE DRAWINGS

The foregoing summary, as well as the following detailed description of a preferred embodiment of the present invention will be better understood when read with reference to the appended drawings, wherein.

DETAILED DESCRIPTION OF THE PREFERRED EMBODIMENT

Figure 1:
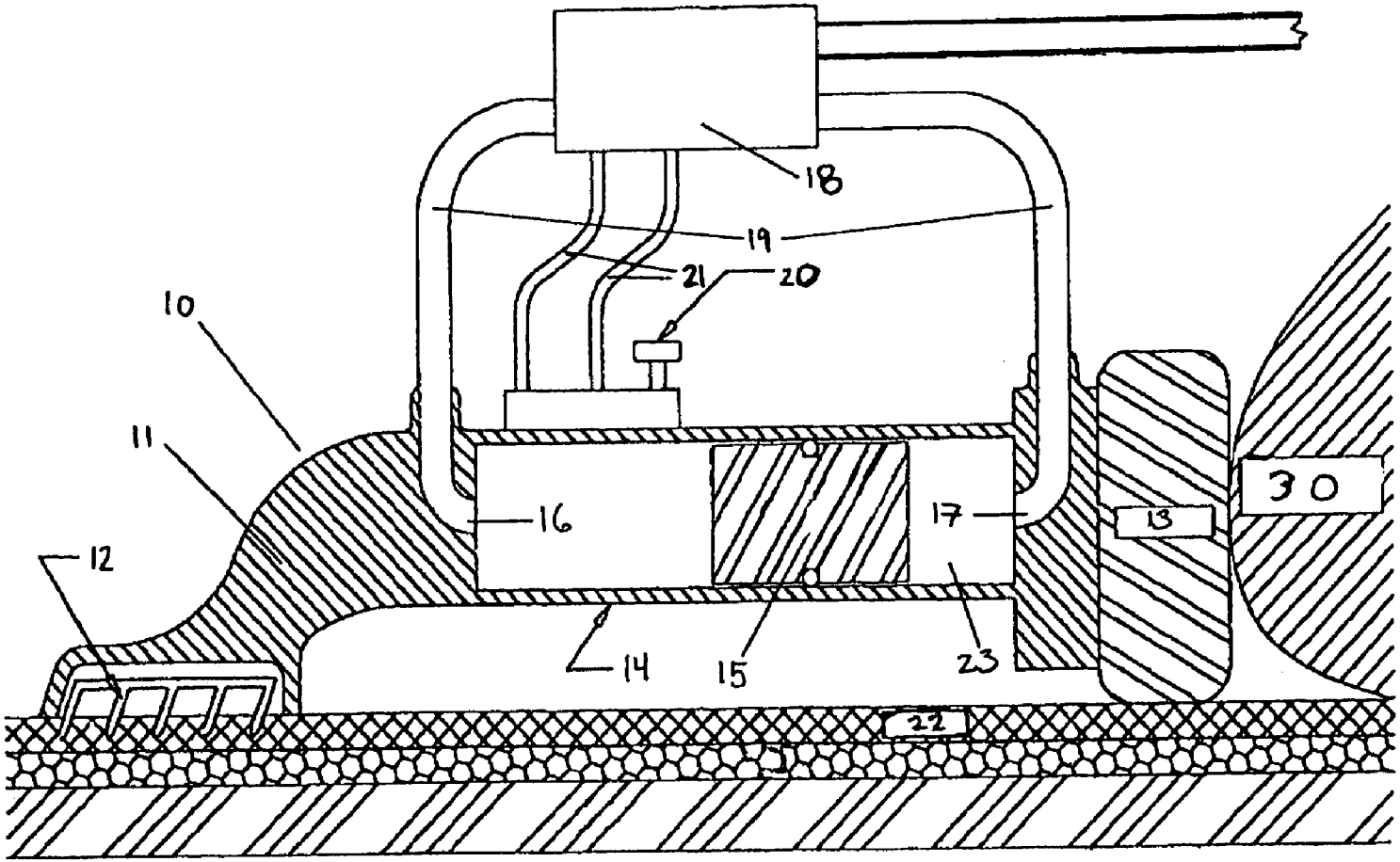
FIG. 1 is a perspective view of a pneumatically powered carpet kicker in accordance with the present invention

Referring now to the drawings wherein like reference numerals refer to the same components across several views, and in particular to FIG. 1, there is shown a powered carpet kicker 10 being used by a carpet installer 30. The powered carpet kicker 10 includes a main frame portion 11, having a head portion and a rear portion.

The head portion of the main frame portion 11 includes a grip 12 mounted on the head portion to grip a section of carpet 22 to be stretched. The rear portion of the main frame portion 11 includes a cushion 13 mounted to the rear portion to provide cushion to an operator's knee 30. The main frame portion 11 includes a momentum creating device 14 to produce linear force towards the head portion in order to stretch the carpet.

In the preferred embodiment, the momentum creating device constitutes a cylinder 23 having a first and second side. The cylinder 23 within the main frame portion 11 includes a piston 15, which travels the complete length of the cylinder 23 between the first and second sides. The cylinder 23 also contains a first 16 and second 17 port at both the first and second sides of the cylinder. The first 16 and second 17 ports are connected by a set of tubes 19 to a pneumatic power source. The power source thrusts the piston quickly forward from one cylinder end to the other 18. The pneumatic means 18 to thrust the piston includes a pneumatic control valve 20 to control the direction and speed of the piston, and is connected to the pneumatic means by 18 way of tubing 21. As the piston is thrust forward against the head position, it creates force which stretches the carpet.

While the present invention has been described in the context of a pneumatic system, it is to be appreciated that the teachings of the present invention are clearly applicable to any type of powered momentum creating device including hydraulic, electromagnetic or stored energy drive.

The invention claimed is:

1. A power carpet kicker, comprising:

a main frame portion having a head portion, rear portion and underside;

a grip mounted on the underside portion to grip a section of carpeting to be stretched;

a cushion mounted to the rear portion to provide a cushion for an operator's knee;

an electrically powered forward momentum creating device to create linear force toward the head portion to stretch the carpet;

a user-operable means for controlling the amount of force created by the forward momentum creating device.

2. The power carpet kicker of claim 1, wherein the forward momentum creating device comprises an electromagnetic piston assembly.

3. The device of claim 1 wherein the forward momentum creating device comprises a pneumatic piston assembly.

4. A power carpet kicker, comprising:

a main frame portion having a head portion and rear portion and an underside;

a grip mounted on the underside to grip carpeting;

a cushion mounted to the rear portion to cushion an operator's knee;

a cylinder within the mainframe, having a first and second end;

a magnetically charged piston within the cylinder;

a electromagnet mounted at the first end of the cylinder;

a power source to actuate the electromagnet; and a means to transfer the power to the electromagnet in a pattern to control the direction and speed of the piston and to thrust it against the front portion.

5. The power carpet kicker of claim 4, further comprising an additional electromagnet mounted at the second end of the cylinder, actuated by the power source, and controlled by the means to transfer power.

6. A power carpet kicker, comprising:

main frame comprising front and rear portions and a solid metal arm that contacts a carpet at its head portion and rear portion;

a grip mounted at the head portion to grip the carpeting;

a cushion mounted to the rear portion to cushion an operator's knee;

a cylinder within the main frame portion's center having a first and second side;

a lighted piston slidable within the cylinder;

pneumatic means to thrust the piston quickly forward within the cylinder, to strike it against the first cylinder end, and then to return the piston slowly to the second cylinder end; and a pneumatic control valve to control the direction and speed of the piston.

7. The power carpet kicker of claim 6 further comprising:

a pneumatic actuator to activate the control valve and actuate piston movement.

* * * * *